United States Patent [19]

Gralton

[11] 4,267,882

[45] May 19, 1981

[54] HEAT EXCHANGER FOR COOLING A HIGH PRESSURE GAS

[75] Inventor: Gary W. Gralton, Windsor, Conn.

[73] Assignee: Combustion Engineering, Inc., Windsor, Conn.

[21] Appl. No.: 126,227

[22] Filed: Mar. 3, 1980

[51] Int. Cl.[3] ..... F28F 9/26

[52] U.S. Cl. ..... 165/83; 122/338; 165/145

[58] Field of Search ..... 165/145; 122/338; 163/83

[56] References Cited

U.S. PATENT DOCUMENTS

| | | | |
|---|---|---|---|
| 631,426 | 8/1899 | Lanphear | 165/145 |
| 2,840,050 | 6/1958 | Sprague et al. | 122/338 |
| 2,862,480 | 12/1958 | Oberg | 122/379 |
| 3,170,511 | 2/1965 | Guthrie | 165/154 |
| 3,850,231 | 11/1974 | Creek | 165/83 |
| 3,893,427 | 7/1975 | Barratt | 165/145 |
| 4,029,142 | 6/1977 | Van Beukering | 165/145 |

FOREIGN PATENT DOCUMENTS

| | | | |
|---|---|---|---|
| 2656412 | 6/1977 | Fed. Rep. of Germany | 165/145 |
| 603819 | 4/1960 | Italy | 165/145 |

*Primary Examiner*—Sheldon J. Richter
*Attorney, Agent, or Firm*—William W. Habelt

[57] ABSTRACT

A heat exchanger for cooling a hot, high pressure gas and utilizing the heat removed therefrom for generating hot water comprising a first and a second vertically elongated pressure containment vessels, the second vessel disposed coaxially within the first vessel so as to establish an annular space between the outer surface of the second vessel and the inner surface of the first vessel. A gas inlet pipe penetrates through the bottom of the first vessel opening into the second vessel at the bottom thereof and a gas outlet pipe penetrates through the top of the first vessel opening into the second vessel at top thereof, thereby providing a passageway for the hot gas to flow through the second vessel. Water is circulated through the annular space between the first and second vessels and heated therein as it absorbs heat lost by the hot gas passing through the second vessel.

6 Claims, 5 Drawing Figures

HEAT EXCHANGER FOR COOLING A HIGH PRESSURE GAS

BACKGROUND OF THE INVENTION

The present invention relates to a method and an apparatus for cooling a high pressure, hot gas laden with ash particles, and more particularly to a heat exchanger for recovering heat from the high pressure combustible product gas produced in a pressurized coal gasifier and utilizing said heat to heat water.

A number of coal gasification schemes have been developed in the past few years which produce a combustible product gas which can be upgraded to pipeline quality to supplement our nation's natural gas resources. The chemical reactions occurring in these gasification processes typically occur at temperatures ranging from 1350° C. to 1650° C. Further, pressures in the range of 15 to 105 kilograms per square centimeter are required in order to satisfy system requirements. Other gas cleaning and processing steps are required subsequent to the gasification reaction to produce a product gas suitable for pipeline transmission. Prior to these gas cleaning and processing steps, it is necessary to cool the product gas leaving the gasification chamber from a temperature as high as 1650° C. to a much lower gas handling temperature typically on the order of 200° to 350° C.

A major problem associated with cooling the product gas leaving the gasification chamber is the high concentration of molten ash in the product gas. The reduced gas volume associated with the high gas pressure results in extremely high ash loadings. Typical ash loadings encountered in pressurized gasifier heat exchange sections exceed 2500 kilograms ash per hour per square meter of flow area as compared to typical ash loadings of 50 to 250 kilograms ash per hour per square meter of flow area in conventional coal-fired power plant heat exchanger sections. Furthermore, precautions must be taken to avoid plugging of the heat exchanger with accumulated ash deposits which could adversely affect the heat transfer and pressure drop through the heat exchange section.

SUMMARY OF THE INVENTION

The heat exchanger of the present invention comprises a first and a second vertically elongated cylindrical pressure containment vessels, the second vessel being coaxially disposed within the first vessel so as to establish an annular space between the outer surface of the second vessel and the inner surface of the first vessel. A gas inlet pipe penetrates through the bottom of the first vessel and extends upward therein to open into the second vessel through the bottom thereof. Similarly, a gas outlet pipe penetrates through the top of the first vessel and extends downward therein to open into the second vessel through the top thereof.

The product gas to be cooled enters the heat exchanger from the reaction chamber through the gas inlet pipe and flows therethrough into the interior of the second vessel and out of the heat exchanger through the gas outlet pipe, the gases are cooled by radiating their heat to the wall of the second vessel. Simultaneously, the water to be heated is conveyed to the annular space formed between the outer surface of the second vessel and the inner surface of the first vessel and is circulated therein. As the water circulates in the annular space, the water is heated to a temperature slightly below the saturation point by removing the heat absorbed by the wall of the second vessel from the hot gases passing thereto. The water is pressurized to a preselected level in order to ensure that none of the water is evaporated to steam before leaving the water jacket formed in the annular space between the first and second vessels.

Further, a heat exchange tube bundle may be disposed within the interior of the second vessel in the upper portion thereof or within the gas outlet pipe in order to heat additional water and further cool the hot gases passing through the heat exchanger. The water circulating through the heat exchange tube bundle may be pressurized to the same level as that circulating through the water jacket or, alternatively, to any other pressure level which may be desired.

DETAILED DESCRIPTION OF THE PREFERRED EMBODIMENT

Figure 1:
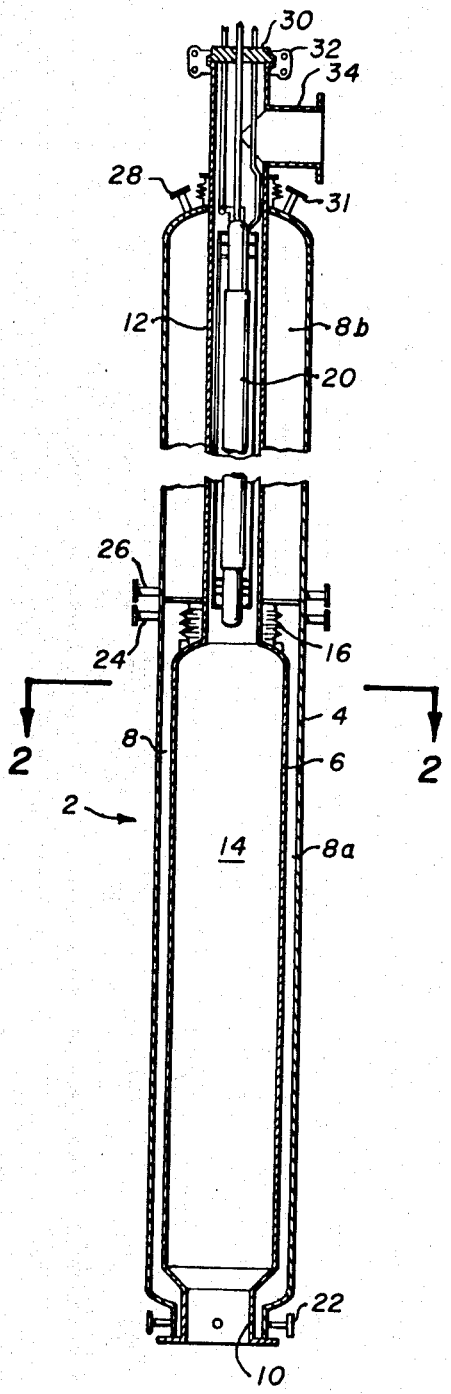
FIG. 1 is a sectional side elevational view of a heat exchanger designed in accordance with the present invention.

Referring now to the drawings and more particularly to FIG. 1 thereof, there is depicted a heat exchanger 2 designed in accordance with the present invention. The heat exchanger 2 comprises a first vertically elongated cylindrical pressure containment vessel 4 and a second vertically elongated pressure containment vessel 6 coaxially disposed within the first vessel 4. The annular space 8 between the outer surface of the second vessel 6 and the inner surface of the first vessel 4 forms a cooling water jacket about vessel 6. A gas inlet pipe 10 penetrates through the bottom of the first vessel 4 and extends upward therein to open into the second vessel 6 through the bottom thereof. Similarly, a gas outlet pipe 12 penetrates through the top of the first vessel 4 and extends downward therein to open into the second vessel 6 through the top thereof.

In operation, high pressure high temperature product gas laden with molten ash passes from a reaction chamber wherein it is produced, such as a pressurized coal gasifier, to the heat exchanger 2 to be cooled therein prior to subsequent gas cleaning and processing operations conducted downstream of the heat exchanger. Such a gas would typically be passed to the heat exchanger 2 at a pressure of 15 to 105 kilograms per square centimeter and at a temperature of 1350° to 1650° C. The hot gas from the reaction chamber, not shown, passes into the heat exchanger 2 through the gas inlet pipe 10 to enter the radiation chamber 14 defined by the interior of the second vessel 6. As the hot product gas flows vertically upward through the radiation chamber 14, the wall of vessel 6 absorbs the heat radiated by the hot gases passing through vessel 6 thereby cooling the hot gases preferably to a temperature less than approximately 980° C. The hot product gas then passes out of the radiation chamber 14 through the gas outlet pipe 12 wherein the product gas is further cooled to a temperature in the range of 200°-350° C.

Simultaneously with the passing of the hot gases through the heat exchanger 2, cold cooling water is conveyed to the annular chamber 8 formed between the inner surface of the first vessel 4 and the outer surface of the second vessel 6. As the cooling water circulates within this water jacket 8, the cooling water is heated by absorbing the heat transferred to vessel 6 by radiation from the hot gases passing therethrough. When the cooling water has been heated to a predetermined temperature, it is conveyed out of the water jacket 8 for disposal or other uses, such as process heating or space heating.

In accordance with the present invention, the cooling water circulated in the water jacket 8 to cool the hot gases passing through the radiation chamber 14 of the second vessel 6 is circulated in such a manner so as to insure that it remains in the liquid state at all times. That is, vaporization of the water within the water jacket 8 into vapor is to be avoided. One method of avoiding steaming is pressurizing the cooling water to a level sufficiently high so as to insure that the temperature of the water leaving the water jacket 8 is below the saturation temperature at that preselected pressure level.

In a further embodiment of the present invention, means are provided for dividing the annular space 8 between the inner surface of the first vessel 4 and the outer surface of the second vessel 6 into a lower water jacket 8*a* and an upper water jacket 8*b*. Each water jacket being equipped with its own inlet and outlet means for conveying cooling water to and from the water jacket independent of each other. Further cooling of the gas may be obtained by disposing a convective heat exchange tube bundle 20 within the second vessel 6 in the upper portion thereof in the vicinity of the entrance to the gas outlet pipe 20 thereby insuring that all the gas flowing through vessel 6 must pass over the convective heat exchange tube bundle 20. To cool the gas, water is circulated through the heat exchange tube bundle 20 in heat exchange relationship with the gases flowing through vessel 6 thereby absorbing heat from the product gases. As with the water circulated in water jackets 8*a* and 8*b*, water is circulated through heat exchange tube bundle 20 in such a manner as to insure that steaming does not occur within the tube bundle and that the water remains in the liquid state.

Figure 2:
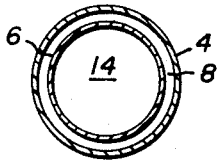
FIG. 2 is a sectional plan view taken along line 2—2 of FIG. 1.

In the preferred embodiment, heat exchanger 2 comprises a first vertically elongated cylindrical pressure containment vessel 4 and a second vertically elongated cylindrical pressure containment vessel 6 being of a substantially shorter length than the first vessel 4 and disposed coaxially within the lower portion of the first vessel 4 as shown in FIGS. 1 and 2. Gas outlet pipe 12 penetrates through the top of the first vessel 4 and extends vertically downward therein to open into the second vessel 6 through the top thereof. A lower cooling water jacket 8*a* is established in the annular space between the first vessel 4 and the second vessel 6 and an upper cooling water jacket 8*b* is established in the annular space between the first vessel 4 and the gas outlet pipe 12 by water jacket division means 16 disposed in the annular space between the first vessel 4 and the second vessel 6 at a location immediately above the top of the second vessel 6. Lower cooling water jacket 8*a* and the upper cooling water jacket 8*b* are equipped with means, such as inlet nozzles 22 and 26 respectively, for conveying cold cooling water into the respective water jackets, and means, such as outlet nozzles 24 and 28 respectively, for conveying heated cooling water out of their respective water jackets.

Figure 3:
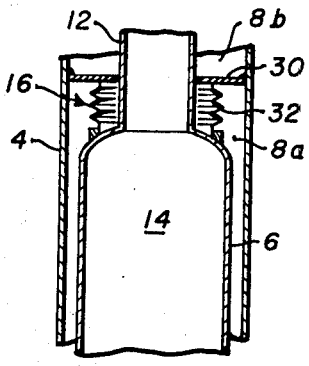
FIG. 3 is an enlarged sectional side elevational view of the water jacket division plate sealing arrangement of the present invention as shown in FIG. 1.

In the preferred embodiment, as best illustrated in FIG. 3, sealing means 16 comprises an annular plate disposed horizontally in the annular space between the first vessel 4 and the gas outlet pipe 12 at a location immediately above the top of the second vessel 6. The annular plate 30 is welded along its outer circumference to the inner surface of the first vessel 4, but along its inner surface, the annular plate 8 is slidably moveable along the outer surface of the gas outlet 12. A flexible, accordian-like ring seal 32 is mounted to and extends between the under surface of the annular plate 30 and the outer surface of the second vessel 6. Thus, the accordian-like ring seal 32 in association with the annular plate 30 form a fluid tight interface between the upper cooling water jacket 8*b* and the lower cooling water jacket 8*a*. By virtue of the accordian-like flexibility of the ring seal 32 and the slidability of the annular plate 30 along the outer surface of the outlet pipe 12, the fluid tight interface between the upper cooling water jacket 8*b* and the lower cooling water jacket 8*a* is maintained despite the existence of relative movement in an axial direction and a radial direction between the first vessel 4 and the second vessel 6 due to temperature differences therebetween.

In the preferred embodiment of the present invention shown in FIG. 1, the gas outlet pipe 12 comprises a vertically elongated open-ended pipe 12 penetrating through the top of the first vessel 4 and extending vertically downward therein to open at its lower end into the second vessel 6 through the top thereof. A removable cap 30 covers the upper end of the vertical pipe 12 and is secured thereto by clamp 32. A gas outlet nozzle 34 opens into the vertical pipe 12 at a location above the top of the first vessel 4 and below the removable cap 30. The gas outlet nozzle 34 provides a flow path for discharging from heat exchanger 2 the product gases passing out of the radiation chamber 14 of the second vessel 6 through the gas outlet pipe 12. In order to allow for differential expansion between the gas outlet pipe 12 and the first vessel 4 at the point where the gas pipe 12 penetrates through the top of the first vessel 4, sealing means 36 is provided.

Figure 4:
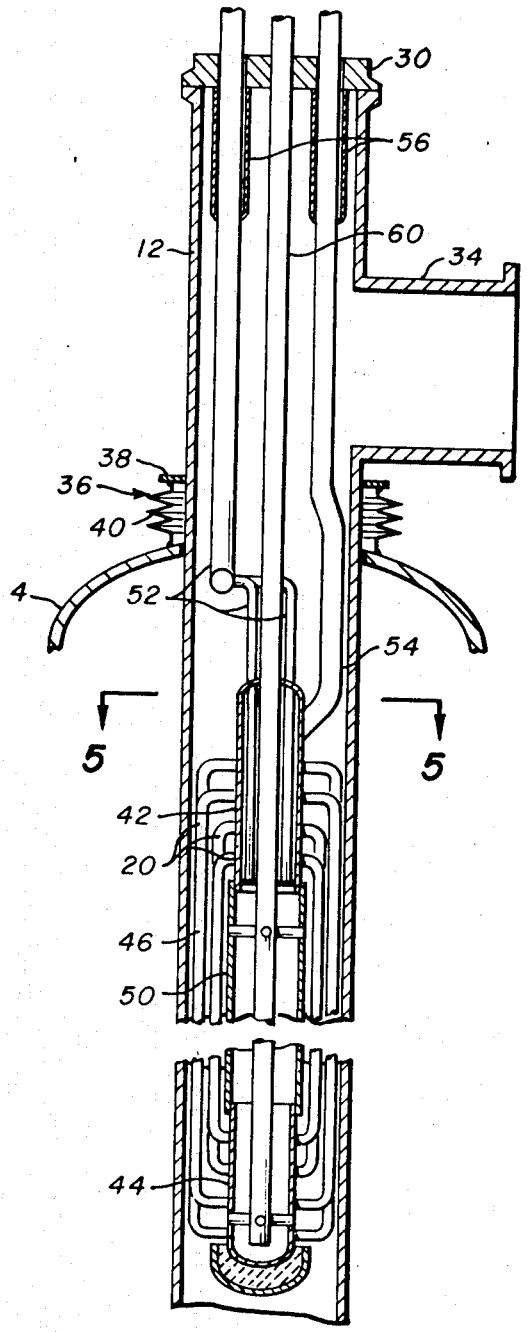
FIG. 4 is an enlarged sectional side elevational view showing the heat exchange tube bundle disposed within the heat exchanger of FIG. 1.

As best seen in FIG. 4, sealing means 36 comprises a ring plate 38 disposed about and welded to the gas outlet pipe 12 at a location just above the top of vessel 4. Outlet pipe 12 penetrates through the top of the first vessel 4 and is along its inner circumference slidably moveable with respect to vessel 4. Ring plate 38 is flexibly connected to the outer surface of the first vessel 4 by means of a flexible, accordian-like annular seal 40 which is secured at its upper end to the under surface of plate 38 and its lower end to the outer surface of vessel 4.

Figure 5:
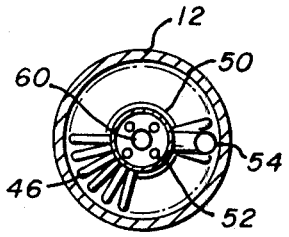
FIG. 5 is a sectional plan view taken along line 5—5 of FIG. 4.

In the preferred embodiment of the present invention, a heat exchange tube bundle is disposed within the gas outlet pipe 12 to further cool the gases passing through the heat exchanger 2. As best seen in FIGS. 4 and 5, the heat exchange tube bundle 4 is removable from the gas outlet pipe 12 through the upper end of the gas outlet pipe 12 when the cap 30 thereto is removed.

In the preferred embodiment, heat exchange tube bundle 20 comprises a vertically elongated cylindrical header vessel 50 divided into an upper chamber 42 and a lower chamber 44, the upper chamber 42 serving as the cooling water outlet header and the lower chamber 44 serving as an inlet header, and a plurality of substantially vertical tubes 46 arranged circumferentially about the header vessel 50 and interconnected between the lower chamber 44 and the upper chamber 42 thereof. Cooling water is fed to the lower chamber 44 of the header vessel 50 through inlet pipes 52 and removed from the upper chamber 42 of the header vessel 50 through outlet pipe 54. After leaving the header vessel 50, inlet and outlet pipes extend vertically upward and pass out of the heat exchanger 2 through the cap 30 to the outlet pipe 12 with thermal sleeves 56 provided at point of penetration to allow for differential expansion between the pipes and the cap.

As the product gas passing through the outlet pipe 12 may still contain a significant amount of particulate matter, specifically dry ash particles, a soot blower 60 is incorporated into the heat exchange tube bundle 20 in order to blow off any ash depositing on the heat exchange tubes 46.

In operation, hot product gases from the reaction chamber such as the pressurized coal gasifier would enter heat exchanger 2 to be cooled therein through inlet pipe 10. The hot pressurized gases, typically at a temperature in the range of 1350° to 1560° C. and a pressure in the range of 15 to 105 kilograms per square centimeter, thence flow vertically upward through radiation chamber 14 within vessel 6 radiating away heat which is absorbed by the walls of vessel 6 thereby cooling the hot product gases so that they leave the radiation chamber 14 of vessel 6 and enter the gas outlet pipe 12 at a temperature of approximately 980° C. The cooled product gases then pass upward through the gas outlet pipe 12 transferring heat to the walls of the gas outlet pipe 12 and to the heat exchange tube bundle 20 disposed within the gas outlet pipe 12 thereby being further cooled before leaving the gas outlet pipe 12 through outlet nozzle 34 to a temperature in the range of 200° to 350° C.

As the hot gases pass through the radiation chamber 14 of vessel 6, low pressure cold cooling water, for example water at a temperature of 150° C. and a pressure of 20 kilograms per square centimeter, is fed to the lower cooling water jacket **8*a* through inlet nozzle 22. The cooling water is heated as it circulates upward through the lower cooling water jacket 8*a* absorbing heat from the wall of the second vessel 6 and exiting from the lower water cooling jacket 8*a* through outlet nozzles 24** at a somewhat higher temperature, for example 180° C.

At the same time, cooling water is fed to the upper cooling water jacket **8*b* between the gas outlet pipe 12 and the first vessel 4 through water inlet nozzle 26, the cooling water being at a low pressure and temperature similar to the water in the lower cooling water jacket 8*a* or alternatively at an intermediate pressure and temperature of for example 230° C. and 65 kilograms per square centimeter. The cooling water circulating within the upper cooling water jacket 8*b* is heated as it circulates upward therein by absorbing heat from the wall of gas outlet pipe 12 and leaves the upper cooling water jacket 8*b* through outlet nozzles 28** at a somewhat higher temperature.

Additionally, high pressure cooling water, typically at a pressure of 170 kilograms per square centimeter and a temperature of approximately 300° C., is circulated through the heat exchange tube bundle 20 disposed within the gas pipe 12 and heated by the product gases flowing therethrough to leave the heat exchange tube bundle 20 at a temperature of about 340° C.

I claim:

1. A heat exchanger for cooling a high pressure, hot gas having a first vertically elongated cylindrical pressure containment vessel, a second vertically elongated cylindrical pressure containment vessel coaxially disposed within said first vessel, the annular space between said first and second vessels forming a cooling water jacket about said second vessel, a gas inlet pipe penetrating through the bottom of said first vessel and extending upward therein to open into said second vessel through the bottom thereof, a gas outlet pipe penetrating through the top of said first vessel and extending downward therein to open into said second vessel through the top thereof, means for conveying cold cooling water into said cooling water jacket, and means for removing heated cooling water from said cooling water jacket; characterized by means for dividing the annular space into a lower and an upper cooling water jacket comprising an annular plate disposed horizontally in the annular space between said first and second vessels, said annular plate being welded along its outer circumference to the inner wall of said first vessel and being flexibly attached to said second vessel so as to slide at its inner circumference along the outer surface of said second vessel as said second vessel moves axially relative to said first vessel in response to thermal influences.

2. A heat exchanger for cooling a high pressure, hot gas comprising:

a. a first vertically elongated cylindrical pressure containment vessel;

b. a second vertically elongated cylindrical pressure containment vessel being of substantially shorter length than said first vessel, disposed coaxially within the lower portion of said first vessel;

c. a gas inlet pipe penetrating through the bottom of said first vessel and extending upward therein to open into said second vessel through the bottom thereof;

d. a gas outlet pipe penetrating through the top of said first vessel and extending downward therein to open into said second vessel through the top thereof;

e. means disposed in the annular space between said first vessel and said second vessel at a location immediately above the top of said second vessel for establishing a lower cooling water jacket in the annular space between said first and second vessels and an upper cooling water jacket in the annular space between said first vessel and said gas outlet pipe;

f. means for conveying cold cooling water into said lower cooling water jacket;

g. means for conveying heated cooling water out of said lower cooling water jacket;

h. means for conveying cold cooling water into said upper cooling water jacket; and i. means for conveying heated cooling water out of said upper cooling water jacket.

3. A heat exchanger as recited in claim 2 wherein said means for establishing a lower cooling water jacket and an upper cooling water jacket comprises:

a. an annular plate disposed horizontally in the annular space between said first vessel and said gas outlet pipe at a location immediately above the top of said second vessel, said annular plate being welded along its outer circumference to the inner wall of said first vessel and along its inner circumference being slidably moveable through the outer surface of said gas outlet pipe; and b. a flexible, accordian-like ring seal mounted to and extending between the under surface of said annular plate and the outer surface of said second vessel, thereby forming in association with said annular plate a fluid tight interface between said upper and lower cooling water jackets.

4. A heat exchanger as recited in claims 2 or 3 further comprising: a convective heat transfer tube bundle disposed within said gas outlet pipe.

5. A heat exchanger as recited in claims 2 or 3 wherein said gas outlet pipe further comprises:

a. a vertically elongated open-ended pipe penetrating through the top of said first vessel and extending vertically downward therein to open at its lower end into said second vessel through the top thereof;

b. a removable cap covering the upper end of said pipe; and c. a gas outlet nozzle opening into said pipe at a location above the top of said first vessel and below said removable cap for discharging the gas passing through said pipe from said second vessel.

6. A heat exchanger as recited in claim 5 further comprising: a convective heat transfer tube bundle disposed within said gas outlet, said tube bundle adapted to be removable from said gas outlet pipe through the upper end thereof when the cap thereto is removed.

* * * * *

UNITED STATES PATENT OFFICE

CERTIFICATE OF CORRECTION

Patent No. 4,267,882 Dated May 19, 1981

Inventor(s) Gary W. Gralton

It is certified that error appears in the above-identified patent and that said Letters Patent are hereby corrected as shown below:

Column 1, line 6, delete "a method and".

Column 7, line 1, cancel "through" and substitute --along--.

Signed and Sealed this

Sixth Day of October 1981

[SEAL]

*Attest:*

GERALD J. MOSSINGHOFF

*Attesting Officer*

*Commissioner of Patents and Trademarks*